US007841973B2

(12) United States Patent
Trancart et al.

(10) Patent No.: US 7,841,973 B2
(45) Date of Patent: Nov. 30, 2010

(54) STRETCH PAL EXERCISE SET

(76) Inventors: Jerome Trancart, Praz-Martin CP 52, Puidoux (CH) 1071; Jana Trancart, 4 Fredric Mistral, Ventabren en Provence (FR)

( * ) Notice: Subject to any disclaimer, the term of this patent is extended or adjusted under 35 U.S.C. 154(b) by 625 days.

(21) Appl. No.: 11/625,327

(22) Filed: Jan. 21, 2007

(65) Prior Publication Data

US 2007/0161480 A1 Jul. 12, 2007

(51) Int. Cl.
*A63B 21/00* (2006.01)

(52) U.S. Cl. ..... 482/131; 482/907

(58) Field of Classification Search ..... 482/131–134, 482/137–138, 38–41, 907; 601/29, 34
See application file for complete search history.

(56) References Cited

U.S. PATENT DOCUMENTS 4,573,678 A 3/1986 Lamb et al.
4,834,073 A * 5/1989 Bledsoe et al. ..... 601/34
4,974,830 A * 12/1990 Genovese et al. ..... 601/29
5,122,106 A * 6/1992 Atwood et al. ..... 482/131
5,137,504 A * 8/1992 Mangini ..... 482/131
5,421,801 A * 6/1995 Davies et al. ..... 482/131
5,460,596 A 10/1995 Brady
6,228,005 B1 5/2001 Gray
6,244,992 B1 6/2001 James
6,296,594 B1 10/2001 Simonson
6,413,198 B1 7/2002 Gray
6,634,995 B1 10/2003 Reed
6,702,724 B2 3/2004 Taylor et al.
7,156,788 B1 * 1/2007 Jackson et al. ..... 482/141
2005/0003935 A1 * 1/2005 Yamauchi ..... 482/79

* cited by examiner

*Primary Examiner*—Fenn C Mathew
(74) *Attorney, Agent, or Firm*—Selwyn S. Berg

(57) ABSTRACT

The invention comprises a versatile compact kit of cooperatively fitting components to be assembled into several geometries of devices capable of being used for the holistic flexion exercise of several muscle groups of the lower torso such as the Achilles tendon, Calf muscles, Hamstrings, Adductor and Lower Back muscles for individual users of different requirements and physical stature.

2 Claims, 9 Drawing Sheets

"The Hamstring Geometry Used In The Sitting On Floor Exercise"

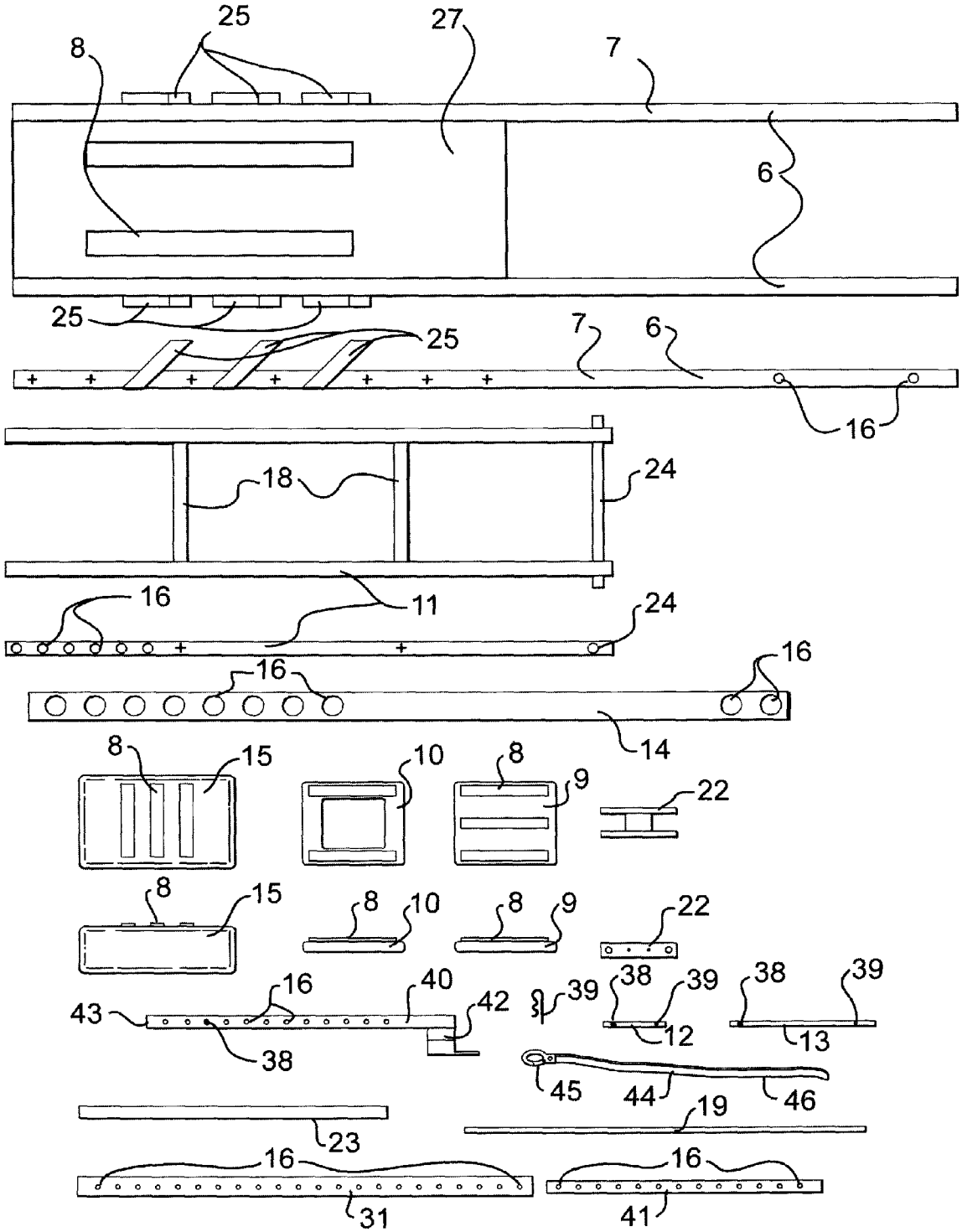
Figure 1. "Simple Independent Components Of The STRETCH PAL Kit"

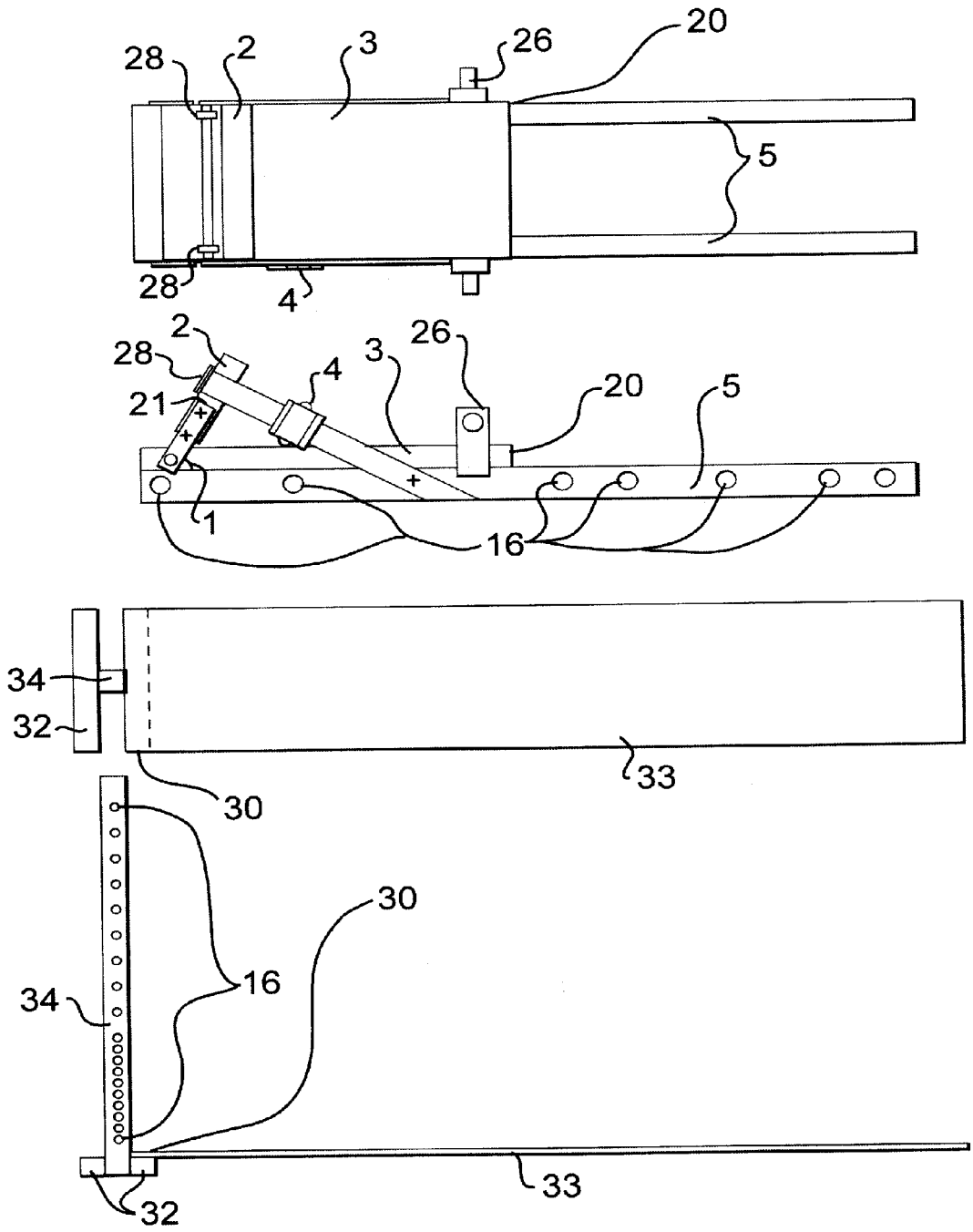
Figure 2. "Major Components Of Foot Cradle and Friction Pad & Extension Stand"

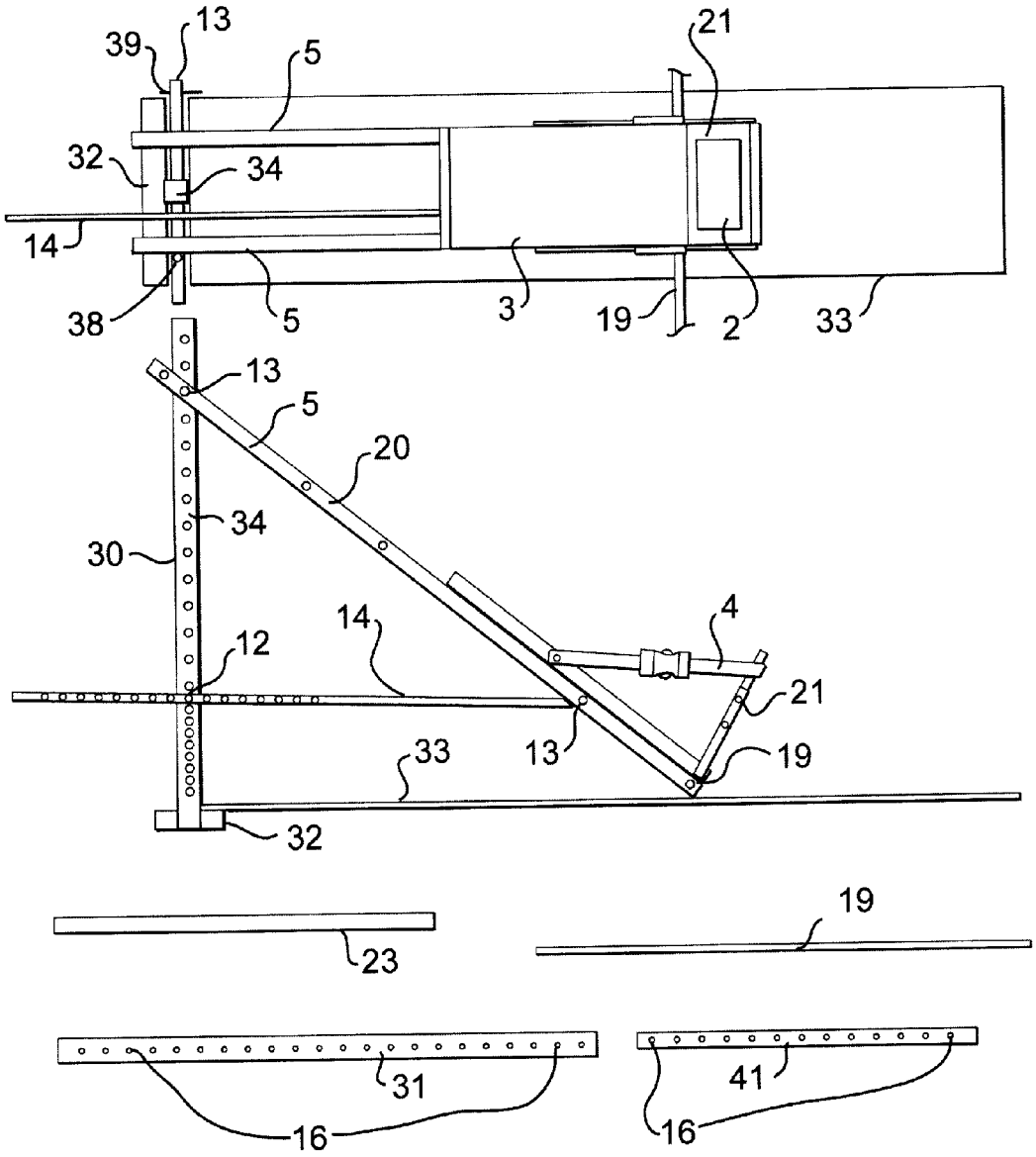
Figure 3. "Details Of The Assembled Calf And Achilles Tendon Exercise Geometry"

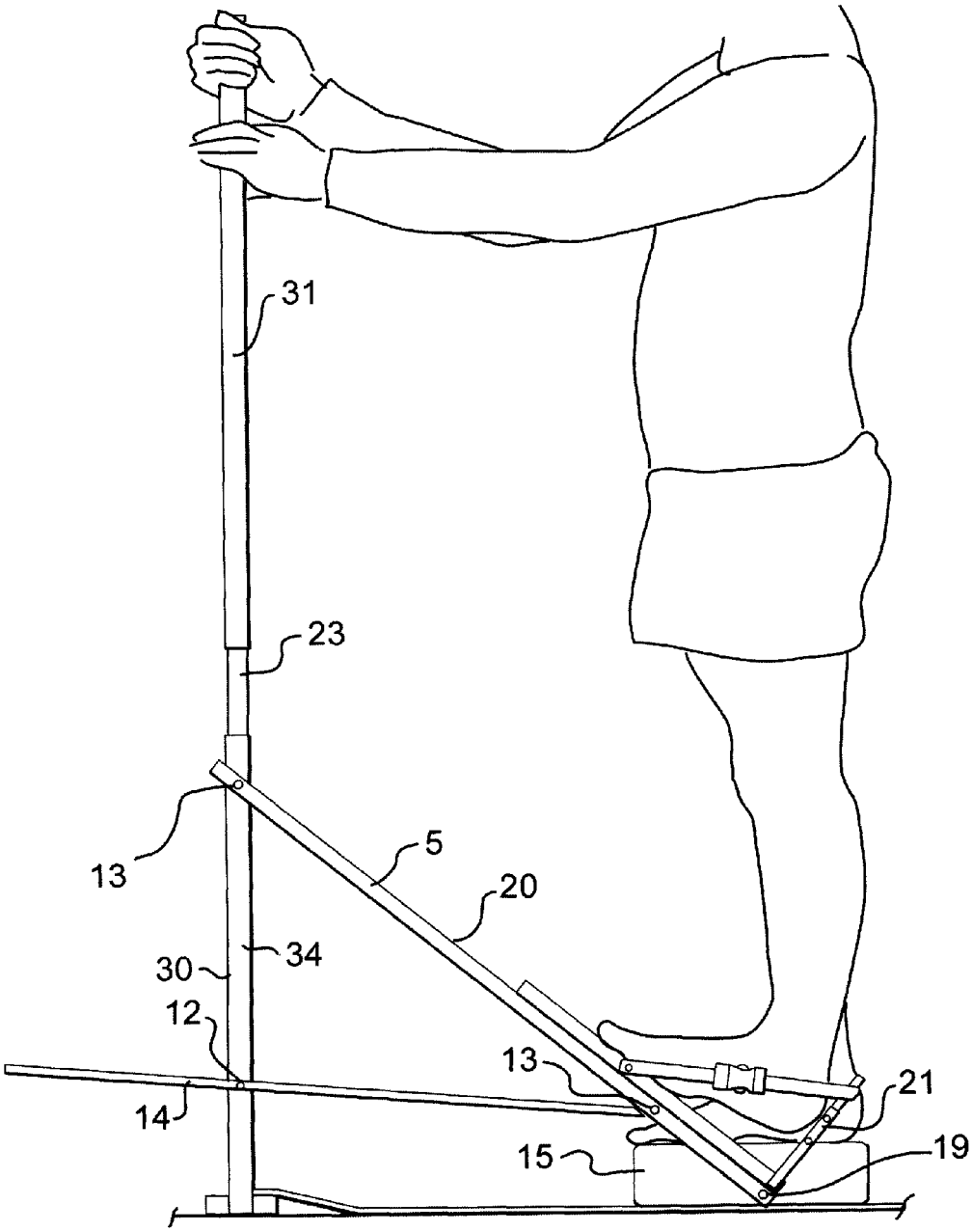
Figure 4. "The Assembled Calf And Achilles Tendon Geometry In Use"

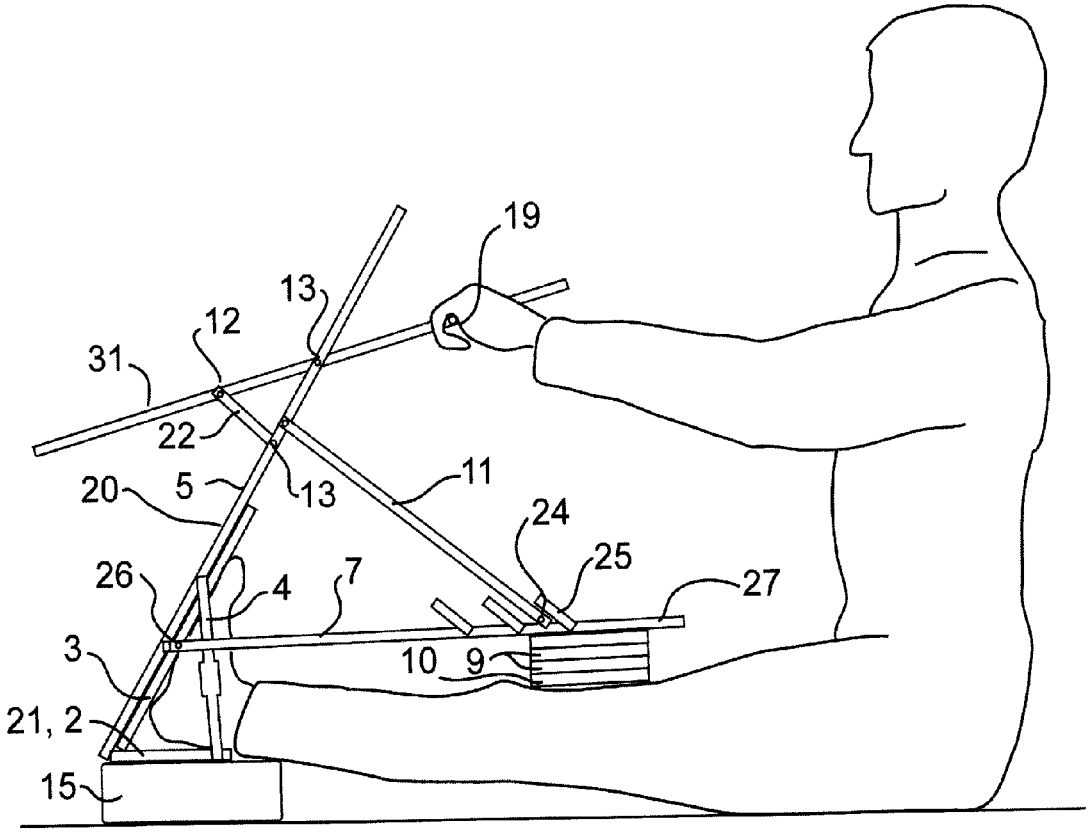
Figure 5. "The Hamstring Geometry Used In The Sitting On Floor Exercise"

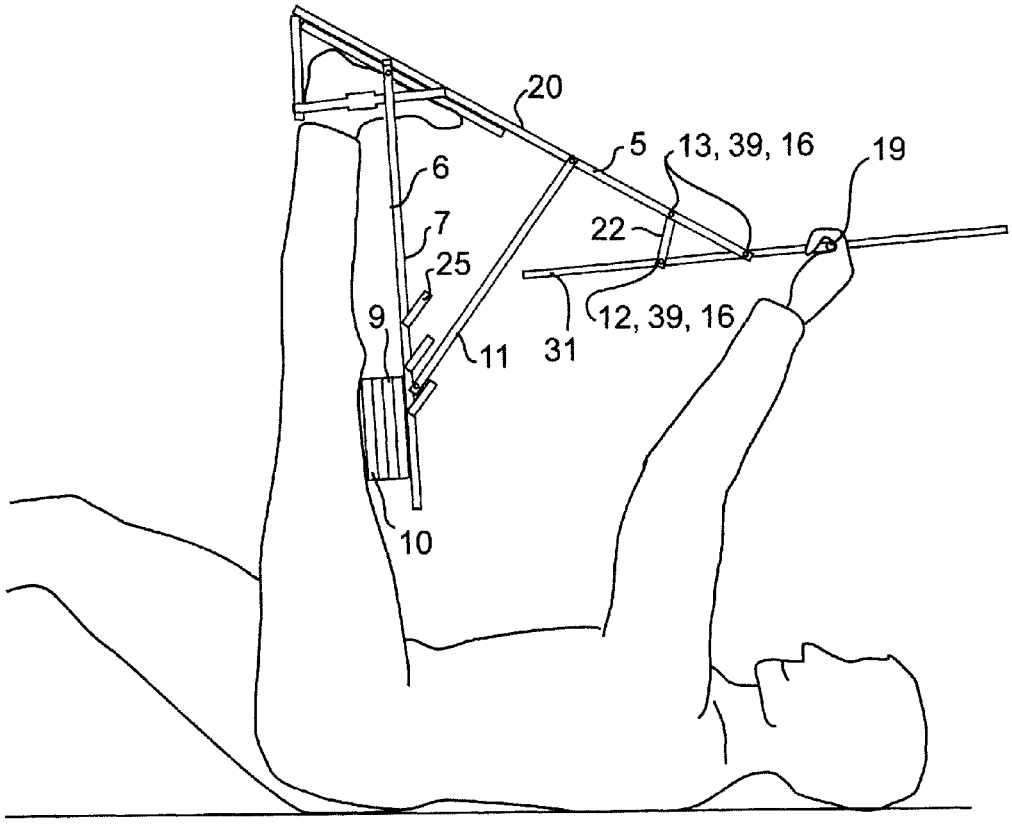
Figure 6. "Hamstring Exercise In The Horizontal Position While Lying On The Floor"

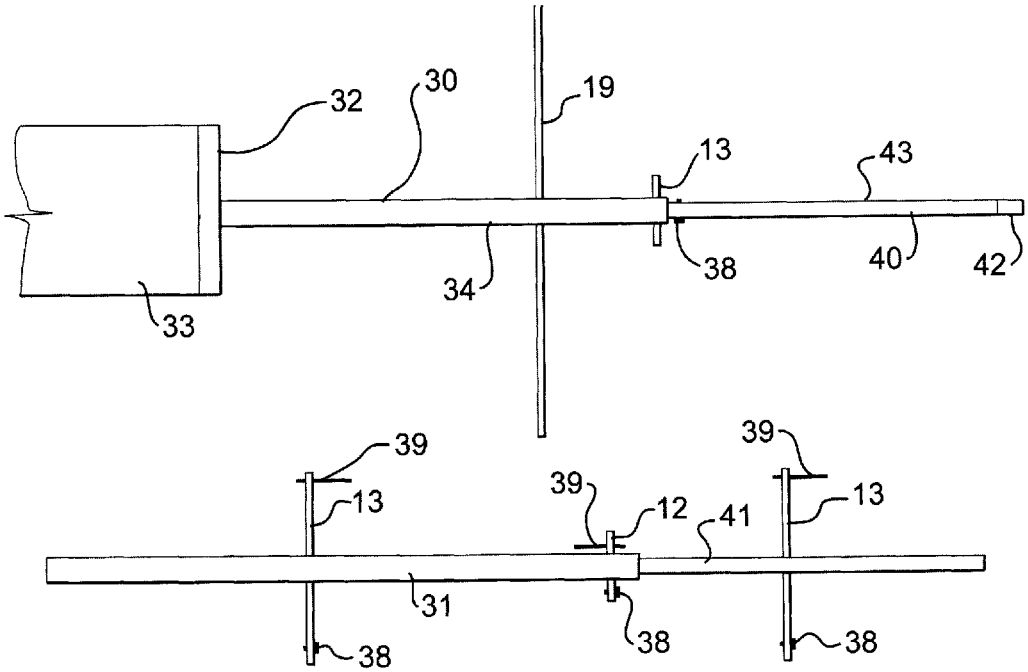
Figure 7. "The Adductor And Back Stretcher Geometries"

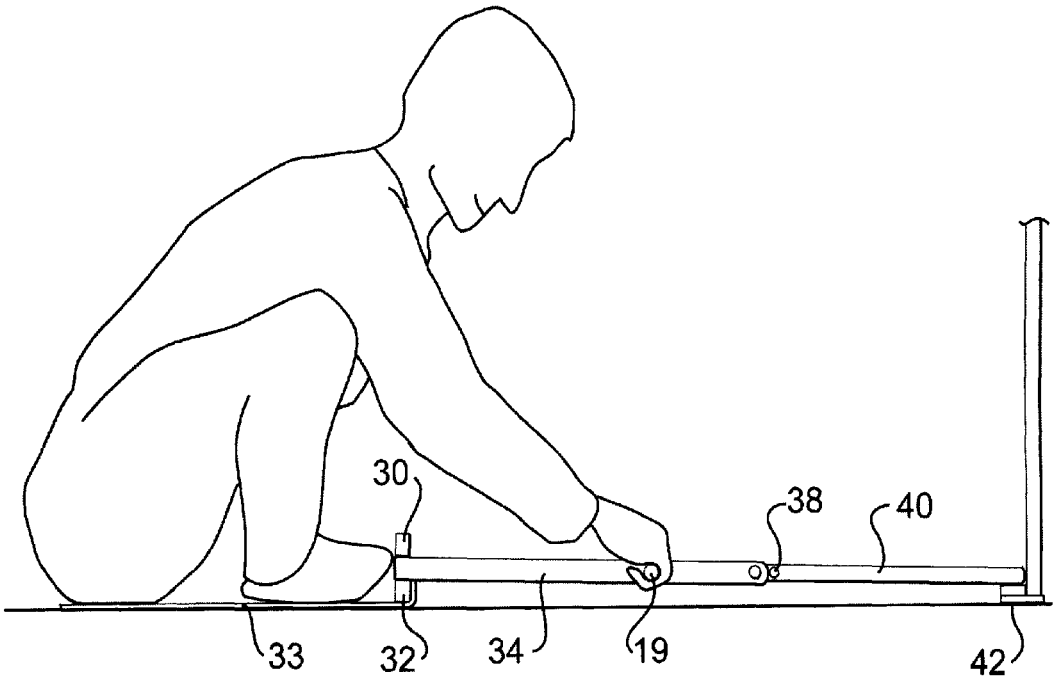
Figure 8. "The Back Stretcher Geometry Used In A Back Stretch Exercise"

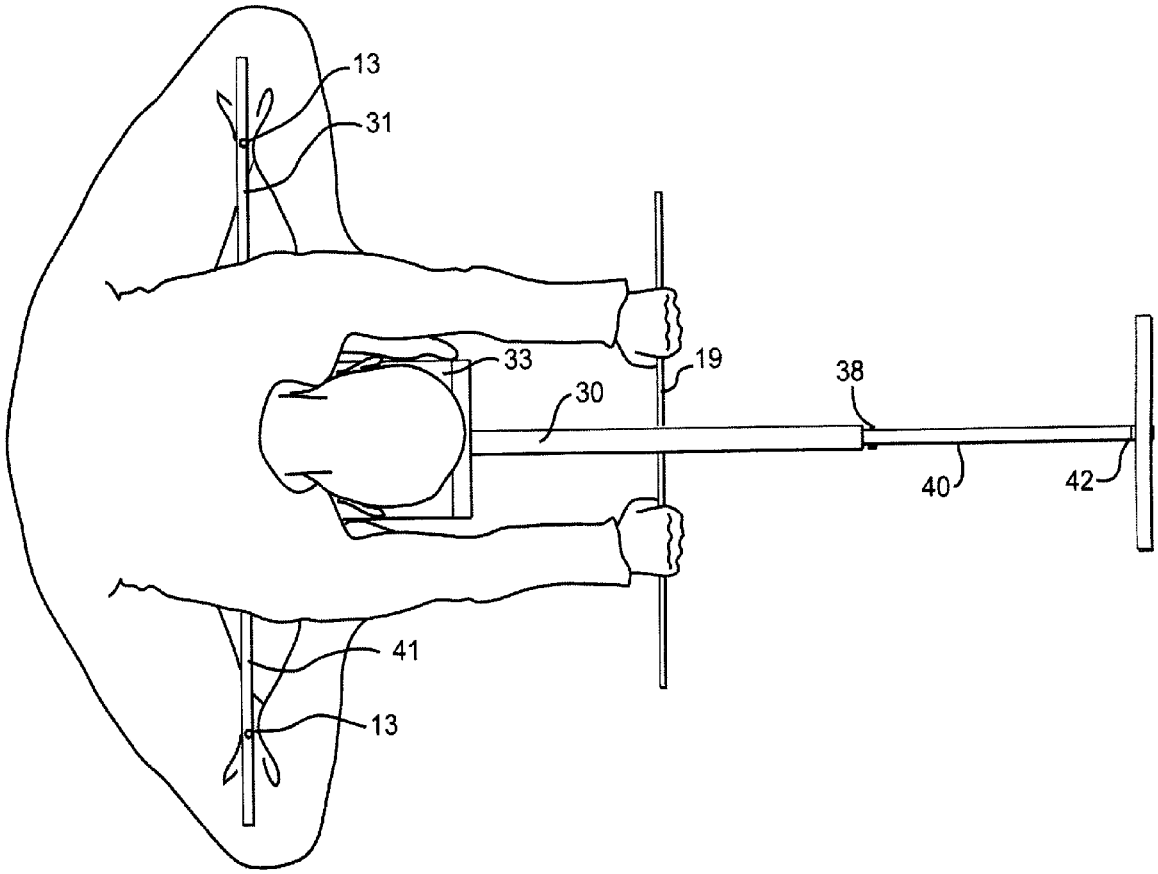
Figure 9. "Back Stretcher Geometry Used In Conjunction With The Adductor Geometry To Stretch The Adductor Muscle Group"

STRETCH PAL EXERCISE SET

BACKGROUND OF THE INVENTION

The BACKGROUND OF THE INVENTION is based on the Field and Prior Art as follows:

1. Field of the Invention

The present invention relates to versatile and collapsible personal exercise equipment intended for the flexion of a variety of muscles in the lower torso. Each configuration is assembled from a kit of cooperating components into several geometries for the flexion exercise of muscle groups of the lower torso.

2. Discussion of Prior Art

There are a variety of muscles that need stretching exercises to avoid injury in many sports, dancing and athletic activities as well as to alleviate strain problems as part of a regimen of physical therapy. Generally athletes and dancers are trained as to proper exercises and patients in the course of physical therapy are under the supervision of appropriate medical practitioners. Too often, such exercise machines are limited in use and geometric layout or bulky and not very portable. The device described herein is a kit of cooperating components that accommodates itself to different geometrical arrangements so that one can selectively flex the Achilles tendon, Calf muscles, Hamstrings, Adductors, and/or Lower Back muscles in a variety of user positions. The exercises so performed are known to comply with the protocol for conditioning the muscles for dancing and sports or for relieving strain which generally causes discomfort in individuals.

The crowded art of exercise devices generally accomplish the same goals by various approaches that are often just subtly different. A major class includes active and passive machines which employ either motors (U.S. Pat. No. 5,421,801; Reed; Apr. 10, 1992: U.S. Pat. No. 5,460,559; Brady; Oct. 24, 1995) or weights (U.S. Pat. No. 6,702,724B2; Taylor; Mar. 9, 2004). These are often bulky, heavy and require special placement and supervision. A danger exists in these machines because of the potential overpowering of the user by the driving energy source. Another class utilizes moving exercise components (U.S. Pat. No. 5,421,801; Davies; Jun. 6, 1995: U.S. Pat. No. 6,296,594B1; Simonson; Oct. 2, 2001) and are limited in physical rearrangements. A hazard exists in these devices if a moving component slips or is maladjusted to an unacceptable limit. The simpler static devices (U.S. Pat. No. 4,573,678; Lamb; Mar. 4, 1986: U.S. Pat. No. 6,244,992B1; James; Jun. 12, 2001) are very limited to the exercises to be performed. Some of the other multiple exercise machines are divided up into stations (U.S. Pat. No. 6,228,005 & U.S. Pat. No. 6,413,198B1; Gray; May 8, 2001 &Jul. 2, 2002) and are quite bulky and complex. The within described device overcomes all the disadvantages of the prior art by providing a simple, lightweight, compact and versatile set of cooperating components which may be assembled into holistic exercise devices intended for the personal use in the consumer market and designed to safely and selectively flex the critical muscles of the entire lower torso. The exercising of each major muscle grouping is specifically targeted according to the geometry of the assembled components. The interoperability of components permits the user to expand and modify the recommended geometries to fit his/her needs and creativity. During each exercise, the amount of stretch flexion is controlled by the user's judgment and limits of his/her toleration. The degree of flexion is always under the immediate control of the user. One can maintain a static pose until the muscle set relaxes into the assumed stance, and then the user progresses simply to the next level by readjusting the exercise components.

SUMMARY OF THE INVENTION

The component parts of the invention are capable of being rearranged into different geometries to correspond to the particular muscle or muscles to be exercised. The various exercise geometries currently envisioned are the Calf and Achilles tendon geometry, Hamstring geometry and the Adductor or Lower Back geometry and these geometries are described as follows.

One of three probable geometrical arrangements of the various components is designated as the Calf and Achilles tendon geometry. In this exercise arrangement, the user balances upright with either foot or both feet in the foot cradle for a length of time as suits his condition. The foot cradle is adjustable by the user to snugly accommodate and flex the ankle. The initial ability of the user to flex his ankle varies with each user and has been shown to change as the user increases his performance. The user sets the adjustable heel angle by the adjustment means so his ankle fits down and into the foot cradle. The foot cradle position is set at an incline to the horizontal as selected by the user. As the user's level of comfort is progressively achieved, he can then select a greater incline angle and change the foot cradle angle adjustment to increase the leg flexion until he reaches his desired goal for flexion of the calf muscle. He can alternate each foot successively into the foot cradle or balance with both feet in the cradle and flex both legs simultaneously.

A second probable arrangement is the Hamstring geometry. Using this exercise geometry, pads press backwards against the knee while the foot cradle holds the ankle in a fixed position. The amount of pressure on the leg is determined by the user pulling on a lever arm which extends at an obtuse angle to the knee pad. Again, an adjustable hand grasp placement permits the progression to a larger lever torque to increase the knee pressure in opposition to the static ankle position. This may be continued to the desired level of Hamstring stretch and then the other leg may be similarly exercised. According to the electron of the user, this may be most easily done with the user sitting in a vertical position or, if he needs his back supported, the user may lie on the floor in a horizontal position. Minor modifications of the basic Hamstring geometry are possible by simple permutations of kit components which will accommodate the various positions of the user as well as his size and build.

Please note that the anatomical functions are such that all the lower torso muscles are interdependent. Hence, the above described Hamstring geometry can also be effectively used to stretch the Calf and Achilles' tendon by reducing the adjustable heel angle to a suitable angle. Though the need for versatility suggests a flexible adjustment means, such as a strap and buckle, a rigid means to maintain a optimum ankle angle is also possible A third probable arrangement is the Adductor or Lower Back geometry. In this third geometry of the components, the user sits in a squat position with shoes on and soles and heels flat against each other, so his knees are spread apart as far as possible. This exercise geometry configuration is generally hooked under a door at one extreme of the device and the user's ankles brace the assembled components to the floor at the other extreme. The user then places two long rods at some initial distal positions on an independent stretch bar, and inserts the lower extension of these inserted rods into the crux of the knee joints. This configuration now braces the knees at "spread eagle" extremities as the user reaches forward for a hand grasp located at some selected position between the door hook and his ankles. Successive placement of the rods and hand grasp to more extreme positions permit the progressive flex exercising of the Adductor muscle.

If the knee spreader bar with the inserted rods is omitted, this same user position assures stretch exercise of the Lower Back muscles. In the lower back exercise, the user advances the hand grasp away from his body position which forces him to bend forward in increasing increments.

In all the exercises, the configuration of each geometry maintains the user's limbs in essentially the same stance within that geometry. This is a static system which is sized to the body build of the user. At all times, the user has full control of the degree of stress he is experiencing and can relieve that stress immediately by his own volition. The objective is to reach a goal of stress to the desired muscle or muscle group at a time and rate set by the tolerance of the user. Inevitably, the best determinant of the safe limit of exercise is the user's pain tolerance.

At the conclusion of the exercises, the system may be disassembled into its major components and stored in a relatively small space. The disassembled components can be easily transported. The invention is intended to be a personal exercise device with a mobility factor which is essential to our modern mobile society.

To simplify the assembly of each suggested geometry, the parts and their positions are encoded, say by distinguishing colors, though other encodings may be used.

These possible geometries and exercise positions described herein are not exclusive of many others that may be devised from the combination of parts and its uses according to the needs and creativity of the user. The use of a set of components which may be cooperatively mated to produce a flexion exercise device suited to the body build of the user as well as the targeted muscle group of the user gives this invention a synergistic result which is unique in passive flexion exercise devices. Considering the number of different geometrical configurations for targeting the different muscle groups, the redundant use of the components makes this set quite economical when compared to the accumulated price of the several exercise devices if purchased separately.

A primary object of the invention is to provide a versatile exercise device to flex exercise targeted lower torso muscles in a safe, comfortable progressive manner.

Another object of the invention is to produce a low cost, light, compact, mobile exercise device for athletes, dancers and those general consumers needing simple physical therapy muscle stretching exercises.

Another object of the invention is to provide a set of versatile interconnecting compatible components designed to permit a user to create lower torso exercise geometries uniquely suited to his/her requirements.

BRIEF DESCRIPTION OF THE DRAWINGS

Further characteristics and advantages of the assembly according to the present invention will become more apparent in the following description of several of its embodiments, given as examples and not limitative, with reference to the attached drawings to be described below.

In these descriptions, a "component" designates an entity which is a functional group and is generally an assembly of individual elements or a machined part or parts. Hence, the Foot Cradle component is comprised of an assembly of aluminum extrusion parts and functions to cradle the foot in each of the geometries that need such a foot cradle. For clarity, components are literally distinguished by using title format in the descriptive text. The "parts" of the components are described in lower case. Parts and components are the "elements" of each geometry. The "geometries" describe the major assemblies of components which are mated together to accomplish the designated muscle flexion exercise.

FIG. 1, titled "Simple Independent Components Of The STRETCH PAL Kit" shows the simpler components of the kit which are to be assembled to create each exercise geometry. Permutations of components achieve versatility within each geometrical arrangement.

FIG. 2, titled "Major Components Of Foot Cradle and Friction Pad & Extension Stand" show the more complex part's assemblies which are used in conjunction with other components to create each exercise geometry.

FIG. 3, titled "Details Of The Assembled Calf And Achilles Tendon Exercise Geometry" shows plan and elevation views of the assembled elements of the Foot Cradle component.

FIG. 4, titled "The Assembled Calf And Achilles Tendon Geometry In Use" shows the Calf and Achilles tendon geometry assembly being used.

FIG. 5, titled "The Hamstring Geometry Used In The Sitting On Floor Exercise." shows the details of the assembled parts and one position of the user performing an exercise to flex the Hamstring.

FIG. 6 titled "Hamstring Exercise In The Horizontal Position While Lying On The Floor." shows a second position of the user performing an exercise to flex the Hamstring.

FIG. 7, titled "The Adductor And Back Stretcher Geometries" shows the details of the geometry assemblies used for Adductor and back stretcher flexion exercises.

FIG. 8, titled "The Back Stretcher Geometry Used In A Back Stretch Exercise" shows the user performing a back flexion exercise.

FIG. 9 titled "Back Stretcher Geometry Used In Conjunction With The Adductor Geometry To Stretch The Adductor Muscle Group" shows the user performing the Adductor muscle flexion exercise with the two geometry assemblies.

For the most part in the within proposed embodiment as shown in the figures, the rigid components and its parts were constructed from light aluminum extruded as solid cylindrical rods, cylindrical tubing, "U" shaped channel and square tubular materials along with screws and rivets which all assures easy prototype construction. However, the parts as shown were not intended to be limiting but only illustrative of the functionality of the defined components which may utilize other engineering materials such as plastics, wood or steel, as dictated by practical production engineering requirements.

Each of the figures were intended to show the functionality of the interconnected components and is not intended to be detailed to the part specification; i.e.; the figures are generally simplified in respect to the actual physical embodiment currently produced. The individual figures are not to any common scale.

DETAILED DESCRIPTION OF THE CURRENT EMBODIMENT

Reference is hereafter made to the attached detailed drawing figures which illustrate and clarify the elements of the embodiment.

FIG. 1. "Simple Independent Components of the STRETCH PAL Kit"

Each of the aforementioned exercise geometries are generally implemented from the combined assembly of the individual simple components of FIG. 1 with the major components of FIG. 2 of the STRETCH PAL kit. For sake of convenience, the diagrams are not shown to any common scale.

There are three (3) Pads 9 components include in the kit. One Pad 9 component is shown here in plan and elevation profiles. Each pad has cooperative tacking means 8 attached so it can be adhered to other components to size and adjust the particular exercise geometry to the needs of the user.

There are available two (2) Frame Pads 10 in the current embodiment of the kit. One Frame Pad 10 is shown here in plan and elevation profiles which have the same overall dimensions as the Pads 9, but have the center section removed. These Frame Pads assure that no excessive pressure is transmitted exclusively to the knee cap, but that the pressure is distributed uniformly and comfortably to the knee region.

The Knee Brace 7 component shown here in plan and elevation profiles is used in conjunction with Calf and Hamstring Geometry exercise by attaching to the Foot Cradle 20 component shown and described in FIG. 2. It is positioned on the Foot Cradle to pressure the knee transversely to the ankle and hip resulting in a flexion of said Calf and Hamstrings as shown in FIGS. 5 and 6. It has tacking means 8 to engage Pad 9 components. The attachment means of Knee Brace 7 component to Foot Cradle 20 component depends on the spring action of the knee brace extension 6 snapping over the knee brace attachment 26 on said Foot Cradle 20 component.

The Door Hook 40 component, shown in use in FIGS. 8 and 9, is used to stabilize the assembled exercise geometry by mating the main shaft up to the stop rivet 38 into the Friction Pad & Extension Stand 30 component (shown on FIG. 2) and inserting into the "L" offset hook 42 under a door.

There is a pair of Foam Bricks 15 components included in the kit.

One Foam Brick 15 component is shown here in plan and elevation profiles which may be used to permit a user to stand level when the particular exercise geometry assembly would have required the user to assume an uneven stance; see FIG. 4. The Foam Brick 15 component is also used to elevate the Foot Cradle 20 component above the user's knee as shown in FIG. 5. These bricks also have tacking means 8 to attach to the Foot Cradle as shown in FIG. 5.

The Stabilizing Rod 19 component is a simple element whose primary purpose is to stabilize the exercise geometry when used in a vertical position as shown in FIGS. 3 and 4 or as a rod for a hand grasp in several of the other exercise geometries as illustrated in FIGS. 5 through 9.

As a general mating means for components in this embodiment the kit contains three (3) Lock Rod 13 components which are used as connecting pins to join components or to use as pins to hold the user's knees spread wide apart in the Adductor flexion exercise as shown in FIGS. 7 and 9. The Lock Rod 13 components are approximately the same length and sized to bridge the width of the components they pin together. Each Lock Rod 13 component has a transverse through hole on one end to accommodate the associated lock pin 39 and a stop rivet 38 on the other end to prevent the rod stock from penetrating the adjustment hole 16 in which it is placed. Each Lock Rod 13 component and the Bridge Rod 12 component is constructed from rod stock of smaller diameter than any adjustment hole 16 and has a stop rivet 38 on one extreme and a lock pin 39 through a hole on the other end. The protrusion of said stop rivet 38 over the diameter of the rod stock creates an obstruction which can not pass through any adjustment hole. When the lock pin 39 is inserted into the hole in the rod, the pin prevents the rod from falling out thereby mating components through their complementary adjustment holes.

The use of a Lock Rod 13 component implies the insertion of the lock pin 39.

The Bridge 22 component shown here in plan and elevation profiles is used in spanning between components as shown in FIGS. 5 and 6.

The short Bridge Rod 12 component is sized to pin the Bridge 22 component in spanning between components as shown in FIGS. 5 and 6, in locking telescoping components together as shown in FIG. 7 or whenever a shortened pin is useful in mating parts. It is a shortened version of the Lock Rod 13 component.

The Outer Telescoping Extending Tube 31 component and the Inner Telescoping Extending Tube 41 component are used in conjunction to extend each particular geometry in which these components are used to accommodate the degree of muscle stress desired and/or the size of the user. To accomplish this objective, said tubes are dimensioned to telescope and have a multiplicity of a regular pattern of aligning adjustment holes 16. They may also be used independently.

The Stiffener 14 component is used to achieve stability and rigidity of associated components as shown in FIG. 3. It has a multiplicity of adjustment holes 16 to assure appropriate sizing of geometries.

The Cross Brace 11 component is used to bridge between the Foot Cradle 20 component and the Knee Brace 7 component as shown in FIGS. 5 and 6. As more fully described in FIG. 5, the engagement dowel 24 locks into engagement studs 25 of the Knee Brace 7 component on one extremity of the Cross Brace 11 component and then at the other extremity an adjustment hole 16 is aligned to mate using a Lock Rod 13 component to the cradle platform 5 of the Foot Cradle 20 component.

The Short Lanyard 44 component which comprises a locking hook 45 and yard 46 is used to hold the Hamstring exercise geometry from a horizontal position to some compatible solid structure. Such arrangement is explained in the FIG. 6 discussion, though not illustrated.

The Inner Reinforcing Tube 23 component can be used to extend a geometry.

Though each component is sized to fit in its respective place when assembling into the various geometries, to facilitate assembling these aforementioned components, a color coding is utilized in the prototype embodiment herein described. The use of a color coding is not intended to be limiting.

The prototype embodiment as described herein employs aluminum extrusion of square dimensions which can be sized to telescope, "U" channels for rigidity, solid cylindrical rods and other simple structural materials to facilitate current construction thereof, and is not intended to be limiting.

FIG. 2. "Major Components of Foot Cradle and Friction Pad & Extension Stand"

In the within described embodiment the Foot Cradle 20 component shown here in plan and elevation profiles is constructed from various extrusions of some light material such as aluminum. A matched pair of legs of rectilinear tubular material forms the cradle platform 5 onto which the foot stool 3 is mounted. Onto said cradle platform 5 is rotatably mounted the heel stool 2 which may be set at an adjustable heel angle 1 with the foot stool 3 by and adjustment means 4 to assure the user's ankle fits snugly and comfortably into said foot stool 3 and heel stool 2. In this FIG. 2 said adjustment means 4 is accomplished by a simple adjustable strap and snap buckle where strap wraps about the back of said heel stool 2 onto the complementary leg of said cradle platform 5. Said strap is restrained by a pair of strap guides 28. A heel cushion 21 is integrated into said heel stool 2 to conform to the user's heel and augment the actual ankle angle the user experiences. The Foot Cradle 20 component has a pair of knee brace attachment 26 points which engage the Knee Brace 7 component.

The Friction Pad & Extension Stand 30 component is used in conjunction with the Calf and Achilles tendon, Lower Back and Adductor exercise geometries. As shown in FIG. 2 it is an assembly of elements which may be described as a friction pad 33 attached to the base brace 32 and is intersected at a right angle by a tubular extension 34 with adjustment holes 16.

FIG. 3. "Details of the Assembled Calf and Achilles Tendon Exercise Geometry"

The Foot Cradle 20 component is mated to the Friction Pad & Extension Stand 30 component in two places to create a rigid construction. Said Friction Pad & Extension Stand 30 component is a simple sub assembly of a friction pad 33 which is attached to a long edge of the base brace 32. The base brace 32 comprises a pair of aluminum tube extrusions attached at right angles to a base extension 34. The base brace 32 is set to the base extension 34 which has a multiplicity of adjustment holes 16 for the setting the Foot Cradle 20 component at an angle to suit the requirements of the user. That angle is set by mating said Foot Cradle 20 component though adjustment holes 16 on the upper segment of the base extension 34. To assure rigidity, the Stiffener 14 component is attached to the lower section of said base extension 34 with a Bridge Rod 12 component through mating adjustment holes 16 and then by a Lock Rod 13 component as the second mating point into said Foot Cradle 20 component.

To assure vertical stability so the geometry will not tip over when used in Calf flexion exercises, the Stabilizing Rod 19 component is inserted half-way through a pair of adjustment holes 16 at the junction of the heel stool 2 and foot stool 3 located at the lower end of the Foot Cradle 20 component. If additional vertical stabilizing support is needed, the Inner Telescoping Extending Tube 41 component and the Door Hook 40 component may be inserted into either of the aluminum tube extrusions of the base brace 32; this additional vertical stabilizing support is not illustrated, but if utilized, it results in horizontal support at both extremities of this geometry.

Also shown in FIG. 3 are the Inner Reinforcing Tube 23 component and the paired Inner Telescoping Extending Tube 41 component and Outer Telescoping Extending Tube 31 component. As more fully described in FIG. 4, these components may be used to extend the exercise geometry in use.

Another perspective of many of the elements defined in this figure is also shown in FIG. 4.

It is noted that there is a multiplicity of adjustment holes 16 to assure versatile settings and mating between components with the use of Lock Rod 13 and Bridge Rod 12 components. Though all components are dimensioned to fit in an obvious manner, the instructions for assembly of the various exercise geometries are supported by an encoding and assembly instructions.

FIG. 4. The Assembled Calf and Achilles Tendon Geometry in Use.

In the Calf and Achilles tendon geometry, the Foot Cradle 20 and the Stiffener 14 components are mated with the Friction Pad & Extension Tube 30 component (see FIG. 3) which is further extended by the use of Outer Telescoping Extending Tube 31 component and Inner Reinforcing Tube 23 component (or just the Inner Telescoping Tube Extending Tube 41 component—shown in FIGS. 1 and 3—inserted singularly into the base extension 34). To create this extension shown in FIG. 4, the Inner Reinforcing Tube 23 component is inserted into the base extension 34 of the Friction Pad & Extension Tube 30 component and then the Outer Telescoping Extension Tube 31 component is sheathed over said Inner Reinforcing Tube 23 component. This connected chain of outer and inner square telescoping tubes provides an extended handle for structural strength, grasping and balance. The Foot Cradle 20 component is more fully described in FIG. 2.

The user can insert either of his feet into the Foot Cradle 20 component and balance by grasping the Outer Telescoping Extending 31 component. To further assure his proper hip alignment and stability a pair of Foam Brick 15 components is provided for the foot not engaged in the cradle.

The cradle is dimensioned to accommodate both feet so the user can therefore simultaneously flex the Calf and Achilles tendon of both legs after the user has developed a balancing confidence in this geometry.

FIG. 5. "The Hamstring Geometry Used in the Sitting on Floor Exercise."

The Hamstring exercise geometry comprises the components of the Foot Cradle 20, Cross Brace 11, Outer Telescoping Extending Tube 31, Bridge 22, Stabilizing Rod 19, Knee Brace 7, Foam Brick 15, Pads 9 and Frame Pads 10 and then associated Lock Rods 13 and Bridge Rod 12 for mating the aforementioned components through appropriate adjustment holes to assure a proper sizing for the user and the degree of flexion desired.

By slight spreading of the knee brace extension 6 the Knee Brace 7 component is hooked in place to the knee brace attachment 26 of the Foot Cradle 20 component.

The Cross Brace 11 component is then bridged from one of the engagement studs 25 on the Knee Brace 7 component to the cradle platform 5 of the Foot Cradle 20 component. In this embodiment, this is done by inserting the engagement dowel 24 of the Cross Brace 11 component into the crux of said engagement studs 25 on the Knee Brace 7 component on one extremity and then at the other extremity aligning suitable adjustment holes 16 to the Foot Cradle 20 component and locking same with a Lock Rod 13 component. Suitable alignment holes is determined by the size of the user and the degree of pressure he/she desires to exert on the knee Complementary tacking means 8 (say hook and eye fabric materials) holds a stack of Pad 9 components and Frame Pad 10 components to the knee platform 27 of the Knee Brace 7 component. The number of pads stacked is determined by the user and the choice of leverage on the knee desired.

If elevation of the heel is desired, a Foam Brick 15 component may be attached to the lower side of the heel stool 2 by a tacking means.

To create a rigid lever arm for the Foot Cradle 20 component, the Outer Telescoping Extending Tube 31 component must be locked to the Foot Cradle 20 component in two places. To accomplish this, adjustment holes on the distal part of the cradle platform 5 is mated with one of the adjustment holes in the Outer Telescoping Extending Tube 31 component by placing a Lock Rod 13 component through mating adjustment holes 16. To lock the lever arm, the Bridge 22 component is also attached by placing a Bridge Rod 12 component through mating adjustment holes 16 on one side of the Bridge 22 component and attaching the other side to a Lock Rod 13 which passes between mating adjustment holes 16 in the cradle platform 5 and said Bridge 22 component. This rigidizes the Outer Telescoping Extending Tube 31 component at an angle that may be determined by choice of adjustment holes 16 on the Inner Telescoping Extending Tube 31 component. The user can then insert the Stabilizing Rod 19 component half-way into one of the adjustment holes 16 on the Outer Telescoping Extending Tube 31 component as a hand grasping handle to pull the knee Brace 7 against the user's knee while the user's foot is positioned on the heel cushion 21 located on the heel stool 2. Said heel cushion 21 conforms to the contours of the user's heel to assure heel is nestled into the angle set by heel-foot adjustment means 4 for the heel position in the foot cradle. To assure a proper elevation of the user's heel above the knee, a Foam Brick 15 component is attached to the bottom of the heel stool 5 by a tacking means.

In this sitting Hamstring exercise of the Hamstring geometry assembly the Pad 9 components and Frame Pad 10 components tacked to the Knee Brace 7 component are pushing the knee of the user in opposition to the foot placed firmly in the junction of the heel stool 2 and foot stool 3 mounted on the Foot Cradle 20 component. The user grasps the Stabilizing Rod 19 component which is inserted about half-way in the Outer Telescoping Extending Tube 31 component which had been rigidly mounted on the Foot Cradle 20 component by the use of appropriate Lock Rod 13 components, Bridge 22 component and Bridge Rod 12 component placed in mating adjustment holes 16. The user may select one of several adjusting holes 16 on said Outer Telescoping Extending Tube 31 component to obtain the knee pressure desired. Elevation of the heel may be desired by the use of a Foam Brick 15 component. By choice of adjusting holes throughout the assembly, the angles of the elemental parts of the geometry may be altered to suit the needs of the user.

Though all parts are sized to fit properly, the embodiment as envisioned herein is to be color encoded to assure the appropriate assembly as per instructions. As will be shown in FIG. 6, some minor changes in the choice of adjustment holes in essentially the same assembly as depicted in this FIG. 5 can be made to size the assembly to the needs of the user and increase its versatility.

Though this geometry recommends the use of the Knee Brace and Cross Brace components, the more experienced user can still achieve the benefits of Hamstring flexion without these two components. Moreover, though this geometry was illustrated with the user sitting on the floor, Hamstring exercises can also be done by standing on one leg and elevating the Foot Cradle 20 component to the users hip level, say by using a small table. However, the standing exercise position requires that the user has a well developed sense of balance.

FIG. 6. "Hamstring Exercise in the Horizontal Position While Lying on the Floor".

On the occasion that the user has to support his back while performing the Hamstring exercise, the Hamstring exercise geometry as shown in FIG. 6 may be employed. FIG. 6 also demonstrates the minor juxtaposition of components illustrated in FIG. 5 to accommodate the variety of needs a user may require to obtain the desired flex goal, sizing or body position. In this FIG. 6, the Outer Telescoping Extension Tube 31 component is repositioned by re-inserting the Lock Rod 13 component somewhere about half-way along said Outer Telescoping Extension Tube 31 component and into an end adjusting hole 16 on the cradle platform 5 and then rigidizing the structure with the Bridge 22 component and its Bridge Rod 12 component to the Outer Telescoping Extending Tube 31 with another Lock Rod 13 component through aligning adjusting holes 16 in both the Bridge 22 component and cradle platform 5. Essentially, this juxtaposition brings the Outer Telescoping Extending Tube 31 component from approximately parallel to the user's leg as shown on FIG. 5 to perpendicular to the user's leg as shown in this FIG. 6. The Stabilizing Rod 19 component which is used as a hand grasp in this geometry may then be inserted into said Outer Telescoping Extending Tube 31 component to bring the grasp as close to the user as needed.

If the user wishes an extended period in this horizontal position and finds his/her extended arm position to the hand grasp tiring, the Short Lanyard 44 component illustrated in FIG. 1 may be substituted for the Stabilizing Rod 19 and the associated Outer Telescoping Extending Tube 31 and Bridge 22 components. To accomplish this, the Stabilizing Rod 19 and the associated Outer Telescoping Extending Tube 31 and Bridge 22 components are removed and the yard 46 of the Short Lanyard 44 component is looped through an end adjusting hole on the extremity of the Foot Cradle 20 component in their place. The locking hook 45 may then be attached to some stable remote fixture. Please note that the attachment configuration described in this paragraph is not illustrated in the drawings.

FIG. 7. "The Adductor and Back Stretcher Geometries".

The Adductor Bar geometry, detailed in the lower half of FIG. 7, is used in conjunction with the Back Stretcher geometry, detailed in the upper half of FIG. 7. The combined use of both assemblies is shown in FIG. 9. The Adductor Bar geometry is assembled by joining the Outer Telescoping Extending Tube 31 component to the Inner Telescoping Extending Tube 41 component and inserting two Lock Rods 13 components with their lock pins 39 into appropriate adjustment holes 16 as suits the user. The Bridge Rod 12 component inserted through appropriate mating holes prevents the tubes from collapsing into each other.

The Back Stretcher geometry, shown in plan profile in the upper half of FIG. 7 and elevation profile in FIG. 8, is assembled from the Friction Pad & Extension Stand 30 and the Door Hook 40 components. The Friction Pad & Extension Stand 30 component is comprised of the friction pad 33 which is attached to the base brace 32 set at right angles to the base extension 34 which is square tubular aluminum channel extrusion designed to telescope over the complementary extrusion of the hook extension 43 of the Door Hook 40 component. The base extension 34 which has a multiplicity of adjustment holes 16 is sheathed over the end of the Door Hook 40 component down to its stop rivet 38. The stop rivet 38 prevents the Door Hook 40 component from collapsing into the Friction Pad & Extension Stand 30 component. For additional security, a Lock Rod 13 component is also inserted through aligned adjustment holes 16 in said base extension 34 and Door Hook 40 component. A hand grasp is accommodated by the Stabilizing Rod 19 component inserted half-way into another adjustment hole 16 of said base extension 34 in said Friction Pad & Extension Stand 30 component at some selected position by the user. The Back Stretcher geometry may be used independently as shown in FIG. 8.

FIG. 8. "The Back Stretcher Geometry Used in a Back Stretch Exercise".

The user places the Back Stretcher geometry illustrated in FIG. 7 with the "L" offset hook 42 of the Door Hook 40 component inserted under a door for stability. To flex the back muscles, the user, sitting on the friction pad 33 with shoes on and heels and soles of each foot together, pulls himself forward by grasping the Stabilizing Rod 19 component. The user can increase his back stretch by putting the Stabilizing Rod 19 component in a more distal adjustment hole 16.

FIG. 9. "Back Stretcher Geometry Used in Conjunction with the Adductor Geometry to Stretch the Adductor Muscle Group".

In this exercise, the user employs the Back Stretcher geometry as shown in FIGS. 7 and 8 in conjunction with the Adductor Bar geometry as detailed in FIG. 7. The user assumes a position similar to that shown in FIGS. 8 and 9 while he has inserted the extension of the Lock Rod 13 components into the crux behind his knees. This causes the user to maintain a spread of his knees while he pulls forward on the Stabilizing Rod 19 component located in some appropriate adjustment hole 16. The user can increase the stretch by selectively extending the Lock Rod 13 component positions to a more distal adjustment hole in the Adductor Bar geometry as well as moving the user's grasp on the Stabilizing Rod 19 component to a more forward position.

Table of Exercise Assignments for Stretch PAL Kit Component

| Call Out | Description Of Component | Exercise Geometry |
|---|---|---|
| 7 | Knee Brace | Hamstring |
| 9 | Pad | Hamstring |
| 10 | Frame Pad | Hamstring |
| 11 | Cross Brace | Hamstring |
| 12 | Bridge Rod | Hamstring<br>Adductor |
| 13 | Lock Rod | All |
| 14 | Stiffener | Calf & Achilles Tendon |
| 15 | Foam Brick | Calf & Achilles Tendon<br>Hamstring |
| 19 | Stabilizing Rod | Calf & Achilles Tendon<br>Hamstring<br>Back Stretcher |
| 20 | Foot Cradle | Calf & Achilles Tendon<br>Hamstring |
| 22 | Bridge | Hamstring |
| 23 | Inner Reinforcing Tube | Calf & Achilles Tendon |
| 30 | Friction Pad & Extension Stand | Calf & Achilles Tendon<br>Back Stretcher |
| 31 | Outer Telescoping Extending Tube | Calf & Achilles Tendon<br>Hamstring<br>Adductor |
| 40 | Door Hook | Back Stretcher |
| 41 | Inner Telescoping Extending Tube | Calf & Achilles Tendon<br>Adductor |
| 44 | Short Lanyard | Hamstring |

What is claimed is:

1. A STRETCH PAL set of cooperatively fitting components for holistic flexion exercise of several of the muscle groups of the lower torso comprising:

a Foot Cradle component for holding a foot on a cradle platform and adjustably nestling an ankle and multiplicity of junction points for size adjustment and mating with other components, a Knee Brace component for transmitting forces to the knee in opposition to the foot with tacking means for holding knee pads and a multiplicity of junction points for bridging to said Foot Cradle component a Cross Brace component which acts as a bridge from said Foot Cradle to said Knee Brace components with a multiplicity of junction points for mating thereby, a multiplicity of Pad components with complementary tacking means for cushioning the knee and adjusting the sizing of the Knee Brace component to accommodate the degree of pressure applied to the knee, a Friction Pad & Extension Stand component which is a base assembly for holding components and having a multiplicity of penetrations as junction points for size adjustment and mating with other components, a Stiffener component having a multiplicity of penetrations as junction points to effect triangular rigidity to an assembly of components a paired Inner Telescoping Extending Tube component and Outer Telescoping Extending Tube component which have a sliding fit for sheathing of one to the other and each having a multiplicity of penetrations as junction points for size adjustment and mating with other components, an Inner Reinforcing Tube component which can slide into other tubes of larger cross sectional area for extending and reinforcing the larger tube, a Bridge component with a pair of junction points for interconnecting Telescoping Extending Tube components to the Foot Cradle component, a Door Hook component having a multiplicity of penetrations as junction points for size adjustment and mating with the Friction Pad & Extension Stand component to secure the combination thereof under a door, a multiplicity of Lock Rod components of diameter to fit through penetrations for sizing the component assemblies and joining together mating components, a Bridge Rod component of dimensions to sit snugly through penetrations of said Bridge for attachment to Inner Telescoping Extending Tube or Outer Telescoping Extending Tube components a pair of Foam Brick components to adjust the angular attitude of the user to the configuration of the assembled components, a Stabilizing Rod component of diameter to fit through penetrations for stabilizing the Foot Cradle component or providing a grasping handle, and a Short Lanyard component for attaching a component assembly to some secure holding point for an extended time period, whereby combinations and permutations of selectively interconnected aforementioned components may be assembled into geometries which complement flexion exercise of muscle groups of the lower torso.

2. The STRETCH PAL set of claim 1 comprising a combination of selected components whereby the combined components create an exercise Geometry for flexion exercise of the lower torso.

* * * * *